United States Patent [19]

McDonald

[11] Patent Number: 4,567,821

[45] Date of Patent: Feb. 4, 1986

[54] APPARATUS FOR ASSEMBLING WOODEN TRUSSES AND THE LIKE

[76] Inventor: William D. McDonald, Rte. 1, Box 322C, Monroe, Oreg. 97456

[21] Appl. No.: 618,587

[22] Filed: Jun. 8, 1984

[51] Int. Cl.[4] ..... B30B 15/06

[52] U.S. Cl. ..... 100/100; 100/218; 100/256; 100/295; 100/913; 269/910; 227/152

[58] Field of Search ..... 100/100, 218, 256, 913, 100/295; 227/152; 269/910

[56] References Cited

U.S. PATENT DOCUMENTS

| | | | |
|---|---|---|---|
| 3,068,483 | 12/1962 | Moehlenpah et al. | 100/913 X |
| 3,068,484 | 12/1962 | Moehlenpah et al. | 100/913 X |
| 3,255,943 | 6/1966 | Sanford | 100/913 X |
| 3,960,070 | 6/1976 | McClure | 100/256 X |
| 4,174,061 | 11/1979 | McDonald | 100/913 X |
| 4,262,588 | 4/1981 | McDonald | 100/913 X |

*Primary Examiner*—Billy J. Wilhite

*Attorney, Agent, or Firm*—Chernoff, Vilhauer, McClung, Birdwell & Stenzel

[57] ABSTRACT

Apparatus for use in assembling wooden trusses and girders by holding wooden members in proper location and orientation while fastener plates are pressed into place. A frame supports an adjustable grid for supporting a clamp table at the location of each joint between wooden members, and a tower, moveable along the length of the frame, carries an articulated boom supporting an upper clamp assembly which is matable with each clamp table to press fastener plates into opposite sides of the wooden members to join them together. The apparatus is extendable and includes a wheeled undercarriage which is removeable.

24 Claims, 13 Drawing Figures

FIG. 8
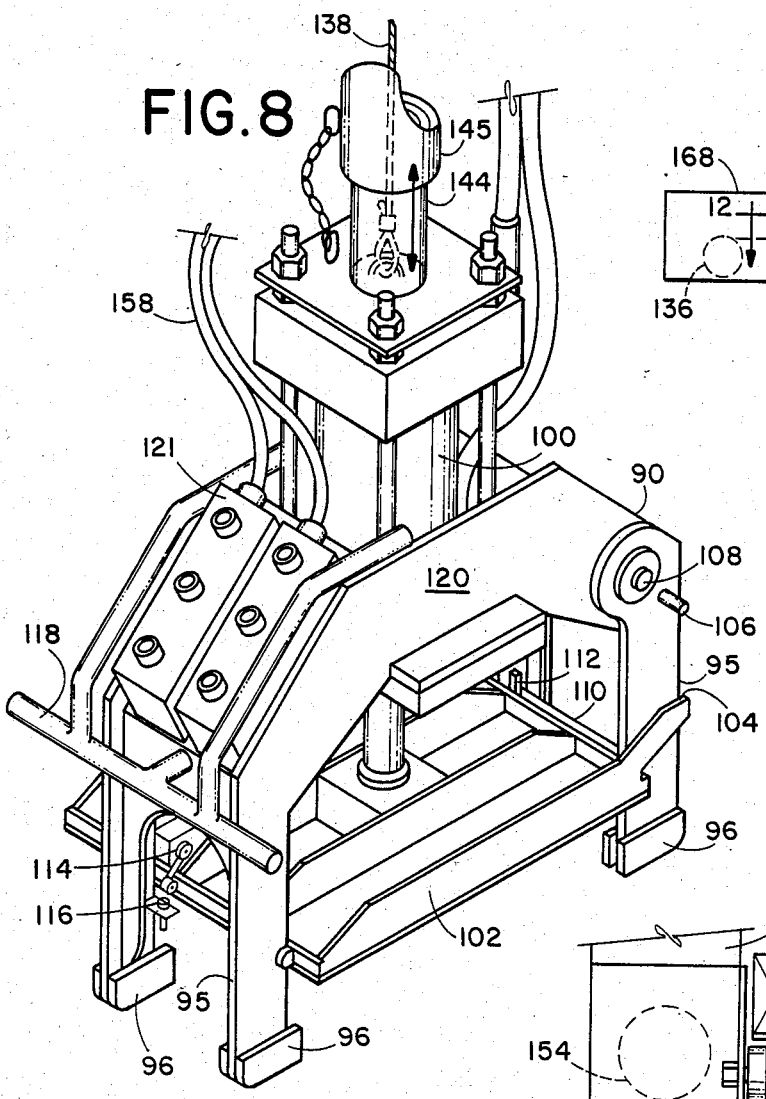
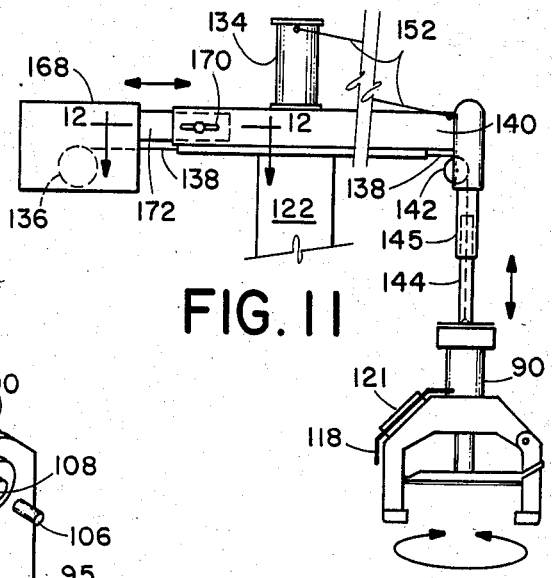
FIG. 11
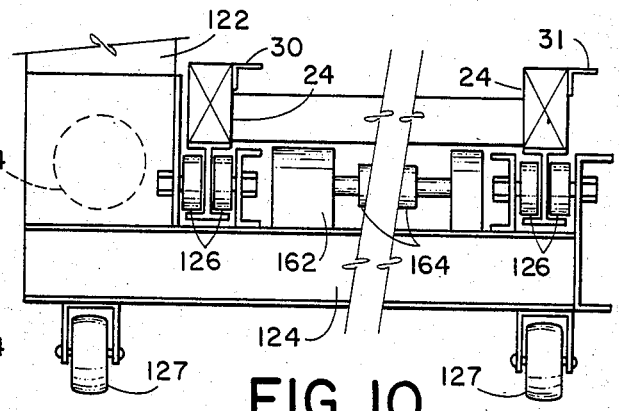
FIG. 10
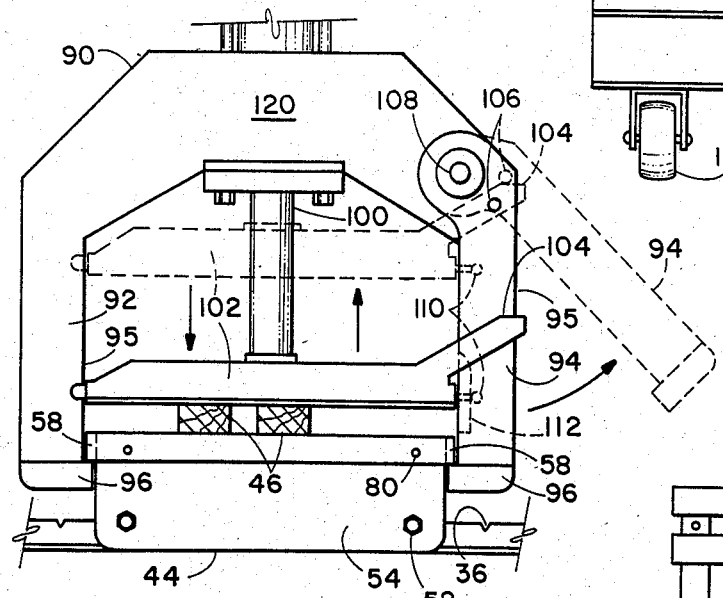
FIG. 9
FIG. 13
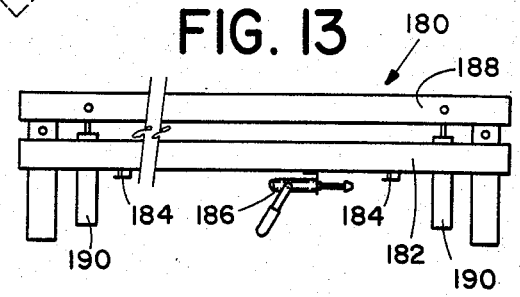

APPARATUS FOR ASSEMBLING WOODEN TRUSSES AND THE LIKE

BACKGROUND OF THE INVENTION

The present invention relates to improved apparatus for use in assembling lumber, together with special fastener plates, to make trusses and girders in a wide variety of sizes and designs.

Wooden trusses and girders for use as structural members of buildings are commonly assembled of dimension lumber cut to proper lengths and held together by specially designed fastener plates which include multiple prongs which protrude into the lumber. Efficient manufacture of such trusses and girders requires the ability to cut, align, and fasten pieces of lumber both quickly and accurately. While such trusses and the like can be assembled manually, a jig is usually required in order to produce them efficiently. In the past, for this reason, trusses have usually been built in large numbers in factories, using jigs and stationary pressing equipment.

There are, however, several disadvantages to construction of trusses in factories. A principal disadvantage is the additional cost of transportation of assembled trusses, compared with the cost of transporting lumber, since assembled trusses take up a much greater amount of space. If therefore requires a larger number of trucks and a larger amount of fuel to transport them. Additionally, transportation of already-assembled trusses removes the opportunity for quality control during their assembly from the contractor who will ultimately be responsible for the quality of the building constructed using such trusses.

Another disadvantage of factory assembly of trusses is that the overhead expenses involved with construction of trusses at a factory, rather than at a construction site, are significant, since a factory building and the land on which it stands must be maintained and will be taxed, and the initial cost of installation of the machinery normally used in truss manufacture in the past is quite expensive. Profitability of a factory installation depends on the end market for assembled trusses being close enough to the factory that economies of production scale will absorb transportation costs.

Yet another disadvantage of factory construction of trusses is the amount of lead time required to ensure that assembled trusses can be delivered when required to avoid construction delays for lack of materials.

Because of the disadvantages of factory construction of trusses, portable equipment has been developed to manufacture trusses. The need to be able to quickly locate pieces and connect them to one another to make several identical trusses accurately and quickly must be combined in such machines with the ability to modify the jig arrangement to provide for assembling trusses of different designs and sizes conveniently. In particular, McDonald U.S. Pat. Nos. 4,174,061 and 4,304,046 disclose portable apparatus for fabricating wooden trusses. Apparatus of this general type previously available has typically used a press suspended from a boom to set fastener plates to join together the parts of a truss by pressing them into the wooden truss members. Such presses have typically been of the C-clamp type, or of the scissors type disclosed in McDonald U.S. Pat. No. 4,262,588. While such presses are capable of assembling roof trusses, they do not always have a deep enough reach for assembly of floor girders where the lumber pieces are assembled in a different orientation requiring fasteners to be set in the more widely separated edges of the lumber.

Because the presses which have been previously used include a pair of opposing jaws and a motor to force the jaws together to set fastener plates into wooden truss members the suspended weight of such presses is quite substantial. The amount of the weight causes several problems, making it desirable to have available a lighter press. The weight of a heavy press limits the span or increases the weight of booms to support it. Limited boom span limits the size of trusses which can be assembled using apparatus including such a heavy press. A heavier press also requires more force or time to move it from position to position for use in assembling trusses.

There is also a risk of unintentionally crushing one's hands, or damaging the press or boom by inappropriately using a press which is complete in itself.

A requirement exists, then, in view of the previously available apparatus for assembling wooden trusses, for a truss-assembling apparatus capable of easily being adjusted to assemble trusses of a wide variety of sizes and designs including floor girders as well as roof trusses, and including a press of adequate capacity but of lighter weight and improved safety in comparison with previously available presses for this purpose. Such apparatus should preferably be self-contained and sufficiently portable to permit its use at a construction site, rather than requiring a central factory location for assembly of trusses.

SUMMARY OF THE INVENTION

The present invention overcomes many of the shortcomings of the previously available apparatus for assembling wooden trusses and girders by providing apparatus including an adjustable jig system including supports for the ends of all pieces of lumber being assembled as a truss or the like, a press including a moveable portion which is light in weight, a tower which is moveable along a main frame of the apparatus, and an articulated boom mounted on the tower for supporting the moveable portion of the press. The resulting greatly increased area where the press can be used gives the appartus of the invention the capacity to assemble trusses of sizes larger than those which could be assembled using previously available portable truss assembling apparatus.

The truss assembling apparatus of the present invention includes an elongate frame. Supported on the frame are longitudinal grid support members which are notched at regular intervals along their lengths to receive moveable transverse support members at selected notch positions, establishing a basic grid. Each of the transverse support members is also notched at regularly spaced locations to receive clamp tables at selected positions along the width of the apparatus. The clamp tables can be positioned in the notches of the transverse support members at locations where the wooden members to be assembled as a truss meet one another to be joined. Spring loaded material support rails are provided on each of the clamp tables to hold the wooden truss members up high enough to permit placement of a fastener plate below the wooden members after the wooden members are properly positioned ready for assembly. Stops are moveably fastened to the clamp tables so that they can be located as a jig to accurately position each wooden truss member, according to the design of the truss to be assembled.

A tower base is suspended beneath the longitudinal members of the frame and is moveable longitudinally along the frame to move a tower along one side of the frame. The tower extends to a sufficient height above the frame to provide ample clearance for personnel to work on assembly of a truss beneath an articulated boom which is pivotably attached to the top of the tower so as to be rotatable about a vertical axis. The boom includes an inner boom supporting an outer boom, and the total length of the articulated boom is greater than the height of the highest roof truss intended to be constructed using the apparatus. Suspended from the outer end of the outer boom is an upper press assembly including a fixed jaw and a moveable jaw designed to be connected matingly with each of the clamp tables. A motor, such as a hydraulic cylinder-and-piston assembly, is attached to an upper plate included in the upper press assembly and which is moveable downwardly toward the clamp table when the upper press assembly is matingly connected with a clamp table, in order to press fastener plates into wooden members of a truss to join them.

Preferably, the longitudinal grid support members include telescopically nested extension members which are designed to accept notched extension portions of the position-establishing members to support transverse support members beyond the length of the basic frame of the apparatus, so that trusses of lengths greater than the length of the basic frame can be constructed using the apparatus. Thus, truss members can be joined as far beyond the ends of the basic frame as can be reached by the articulated boom and supported by the extension members.

This capacity for building truss members of lengths greater than the length of the basic frame of the apparatus is particularly valuable in using the truss assembling apparatus of the present invention in a portable version in which a wheeled undercarriage is attached beneath the frame in a manner similar to the manner of attaching the tower base to the frame. This attachment permits the wheeled undercarriage to be removed from beneath the frame, leaving the frame supported on jack stands located at the four corners of the frame and permitting the tower to be moved along the entire length of the frame during use of the apparatus.

A hydraulic pump system driven by an electric motor is used to operate the press and to move the tower along the frame. The hydraulic pump is located in the base of the moveable tower, and the moveable tower is moved along the frame under the power of a rotary motor driven by fluid from the pump system and connected to a cable spool around which a cable extends, with the ends of the cable being attached to the ends of the frame of the apparatus.

It is therefore a principal object of the present invention to provide an improved apparatus for assembling wooden trusses, the apparatus including longitudinal and transverse supports and clamp tables defining an adjustable jig for aligning the several pieces of wood for assembly into a truss.

It is another important object of the present invention to provide an improved press including a stationary lower portion and a portable upper portion for use in fixing fastener plates in place to hold wooden trusses together.

It is yet another object of the present invention to provide apparatus for assembling trusses which is capable of assembling trusses and girders larger than those which could be assembled using previously available portable apparatus.

It is a primary feature of the present invention that it includes a two-part press, of which a moveable upper part is lighter in weight then comparable presses previously used in truss assembly apparatus, while the press has a greater height capacity than previously used presses.

It is another important feature of the present invention that it incorporates transverse support members which fit into any of a plurality of possible locations along the length of a main frame and hold clamp tables at any of a plurality of positions spaced laterally across the frame of the apparatus, as an adjustable jig and material support system for arrangement and assembly of wooden trusses.

It is a further feature of the present invention that it includes a tower which is moveable along the length of the frame of the apparatus and which supports an articulated boom assembly supporting a moveable upper portion of a press to each part of the apparatus so that every joint of a truss can be easily reached by the press.

It is a primary advantage of the press of the present invention that, because of its two-part construction, it is easier and safer to use than presses previously used in truss assembling apparatus of this type.

It is another important advantage of the present invention that it can be used to build both roof trusses and floor girders, unlike previously available portable truss assembling apparatus.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 8 is an isometric view taken from the upper right front of the portable upper clamp assembly of the truss assembling press of the apparatus shown in FIG. 1.

FIG. 9 is a side elevational view of the upper clamp assembly shown in FIG. 8.

FIG. 10 is a broken front elevational view showing the manner of suspension of the tower base on the frame of the apparatus shown in FIG. 1.

FIG. 11 is a simplified, broken view showing the arrangement of the outer boom supporting the upper clamp assembly shown in FIG. 8.

FIG. 13 is a broken elevational view of an ejector unit for lifting completed trusses clear from the jig portion of the apparatus shown in FIG. 1.

DETAILED DESCRIPTION OF THE INVENTION

Figure 2:
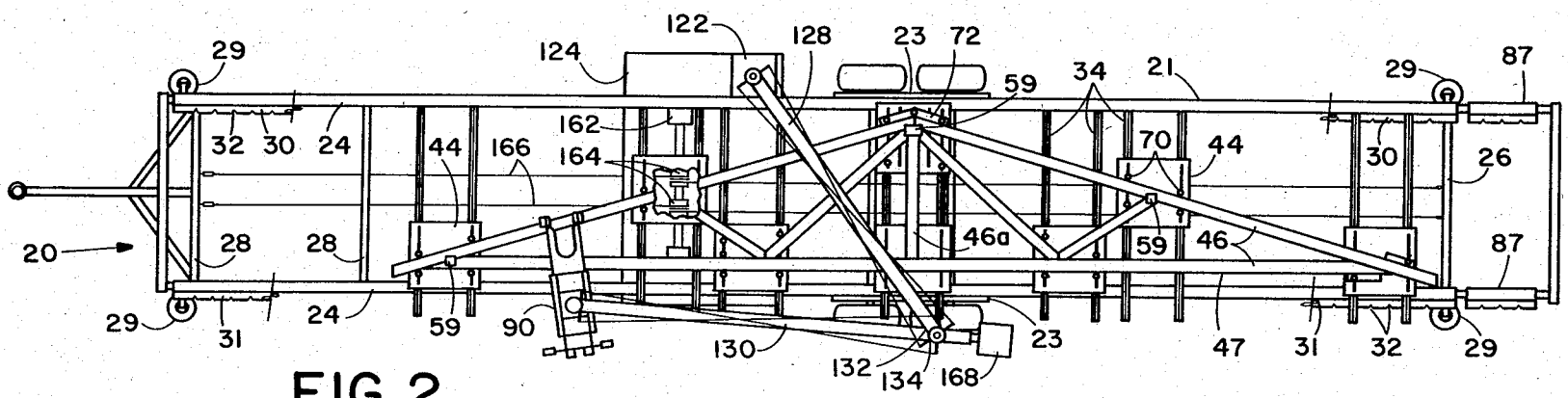
FIG. 2 is a top plan view of the apparatus shown in FIG. 1.
Figure 1:
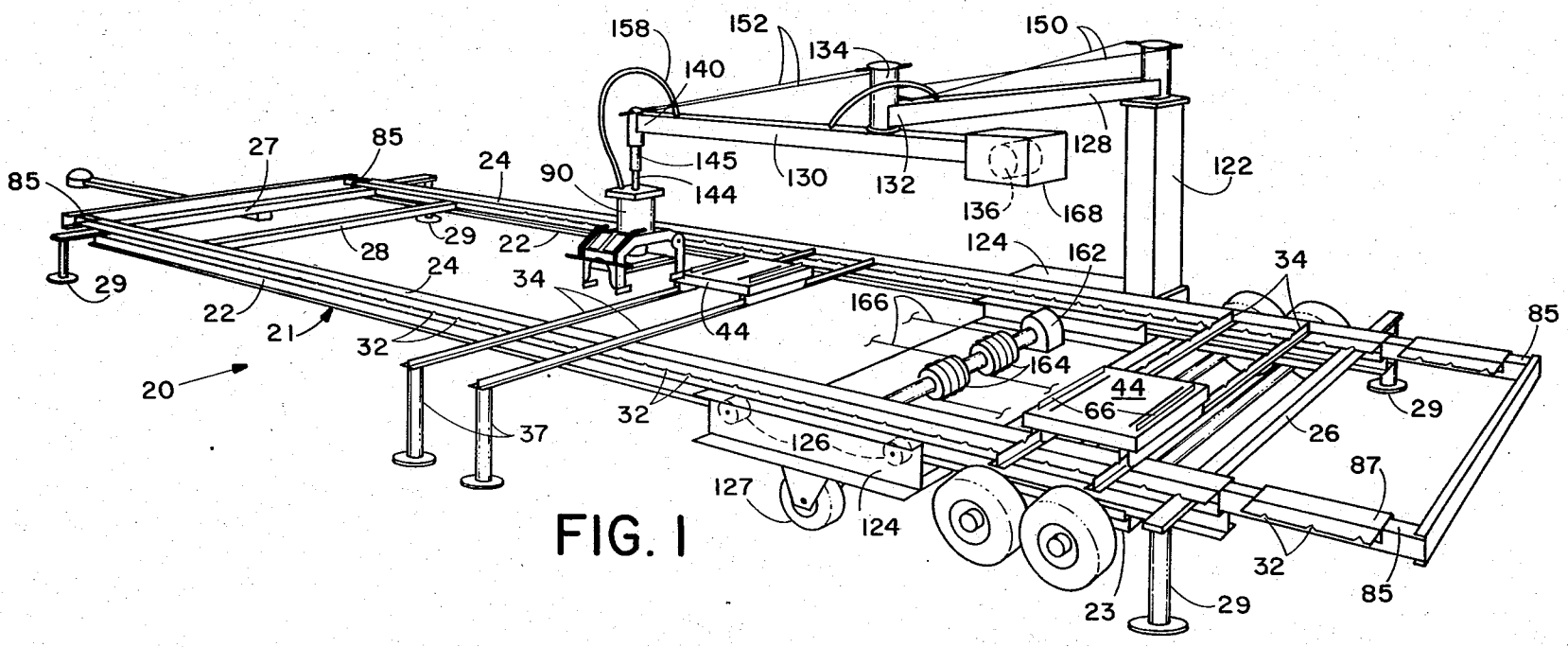
FIG. 1 is a perspective view of an exemplary truss and girder assembling apparatus embodying the present invention.

Referring now to the drawings, an exemplary truss assembling apparatus 20 shown in FIGS. 1 and 2 includes an elongate main frame 21 having main longitudinal frame members 22 which may be in the form of I-beams. A wheeled undercarriage 23 is removably mounted on the main longitudinal frame members 22 and may be secured to them for transit of the apparatus 20 by highway. Preferably, the undercarriage 23 can be removed from the main frame 21 by sliding it off the ends of the longitudinal main frame members 22. Located atop the main longitudinal frame members 22 are longitudinal grid support members 24, which are preferably rectangular tubes. Main transverse members 26 and 27 are located, respectively, at a rear end and a front end of the main frame 21, and additional transverse members 28 (some omitted for clarity) extend between the main longitudinal grid support members intermediate the ends of the main frame. Jacks 29 are located at corners of the main frame 21, attached to the longitudinal grid support members 24, to support the weight of the apparatus 20 when the undercarriage 23 is removed from the frame 21.

Longitudinal position-establishing members 30 and 31 extend along the main longitudinal grid support members 24. The position-establishing members 30 and 31 may, for example, be strips of angle stock, each having a vertical flange welded to the corresponding vertical side of the respective main longitudinal grid support member 24, and a horizontal flange extending away from the longitudinal grid support member 24 to which it is attached. Notches 32 are established at regularly-spaced intervals, for example four inches, along the position-establishing members 30 and 31, and are aligned with one another perpendicularly across the width of the frame 21, establishing a set of regularly-spaced locations for placement of a plurality of transverse support members 34.

Figure 3:
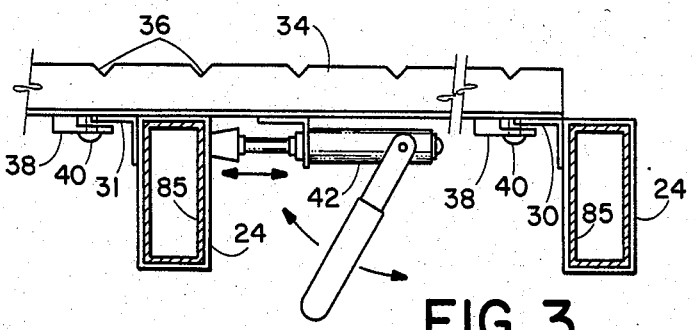
FIG. 3 is a rear elevational detail view showing the manner of attachment of a horizontal transverse support member to the main longitudinal members of the jig of the apparatus shown in FIG. 1.

Each transverse support member 34 is a rail having, for example, an inverted "T" shape, and defines a plurality of regularly spaced notches 36 which are similarly located along the upper side (the base of the inverted "T") of each one of the several transverse support members 34 (FIG. 3). Each transverse support member 34 includes a pair of clips 38 fixedly attached to its bottom side. A vertical pin 40 extends between each clip 38 and the bottom side of the transverse support member 34, with the pins 40 being separated from each other by a distance equal to the distance between the longitudinal position-establishing members 30 and 31, so that both pins 40 fit snugly into the corresponding notches 32 on the longitudinal grid support members 24 to establish firmly the location of each of the transverse support members 34. An over-center lever-operated plunger device 42 is fastened to the bottom of each of the transverse support members 34 so as to push against the main longitudinal jig member 24 when engaged, to hold the transverse support member 34 in a position in which both of the pins 40 are located within the notches 32 of the two longitudinal position-establishing members 30 and 31. A jack 37 (FIG. 1) may be provided to hold an end of a transverse support member 34 extending laterally beyond the frame 21.

Figure 6:
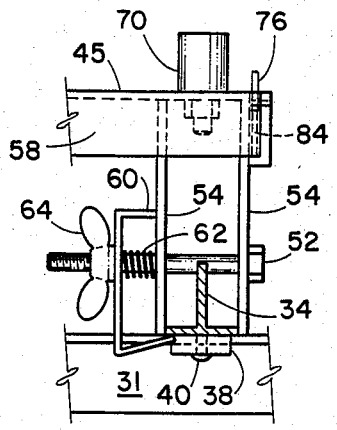
FIG. 6 is a detail view showing one of the hold-down clips of the clamp table shown in FIG. 4.
Figure 4:
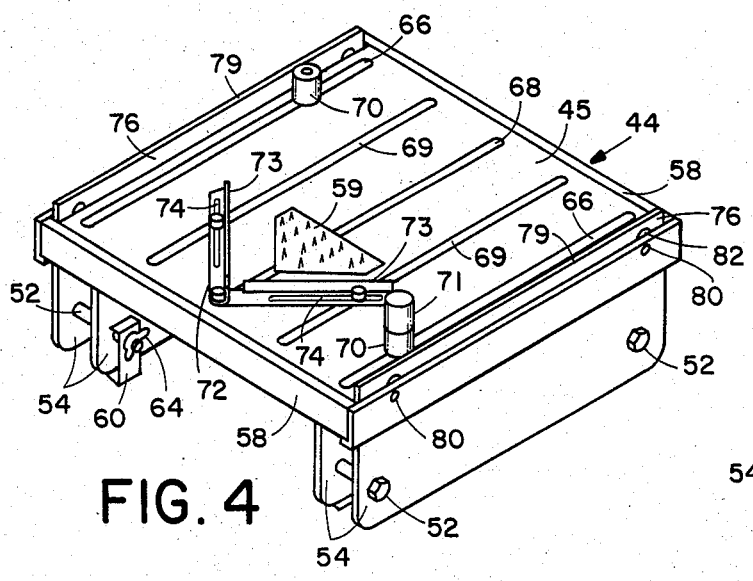
FIG. 4 is an isometric view of one of the clamp tables of the apparatus shown in FIG. 1.

A plurality of clamp tables 44 are positioned atop pairs of the transverse support members 34 at locations established as required to support the portions of the wooden members 46 being joined with one another as a wooden truss 47. The clamp tables are large enough to support the intersection of the wooden members with ample space, being, for example, about twenty inches square. As may be seen more clearly in FIGS. 4–7, each of the clamp tables 44 includes four position-establishing bolts 52, two of which extend through each of two respective pairs of vertical flanges 54 located on two opposite sides of each clamp table 44. The vertical flanges 54 of each pair are parallel with one another and extend downwardly from the clamp table 44, being separated from one another by a distance permitting them to fit snugly alongside the base of the respective transverse support member 34 (FIG. 6).

The clamp tables 44 are of light but sturdy construction, including reinforcing webs 56 welded in place on the bottom side, and having edge strips 58, preferably of solid steel stock and at least about ½ inch thick and 1½ inches high, in order to withstand the forces required to press fastener plates 59 into the wooden members 46, as will be explained subsequently.

A pair of slots 66 are defined in the top of each clamp table 44, and a central slot 68 and two intermediate slots 69 are provided in at least one clamp table 44. The slots 66, 68 and 69 extend parallel with the flanges 54 to receive stops 70 and permit them to be adjustably positioned to hold the wooden members 46 in the proper locations for assembly of a wooden truss 47, as shown in FIG. 2. The top of each stop 70 is generally cylindrical and may extend a distance of, for example 1¼ inches above the top surface 45 of the clamp table 44, when in position. Additionally, each stop 70 may include a threaded central bore for receiving a cylindrical extension 71 (FIG. 4) to increase the height of the stop 70 to provide additional support for wooden members, such as 2"×4" lumber on edge, used in construction of floor girders.

A peak locator 72 is a pair of rails 73 of angle stock hingedly connected with one another and bolted into a preselected position along the central slot 68. Each rail 73 includes a slot 74 to permit it to be bolted in a desired location relative to one of the other slots 69 on either side of the central slot 68, to adjust the locations of the rails 73 as required to hold the pieces being joined to form the peak of a truss 47 in the proper location during assembly.

A clip 60 is located on each of the bolts 52. A spring 62 hold the clip 60 spaced apart from the inner flange 54. The clip 60 is preferably made of strap iron bent to a generally "C" shape having one leg which extends slopingly upward beneath the bottom of one of the flanges 54 and under part of the bottom of a transverse support member 34 when a wing nut 64, threadedly attached to the bolt 52, is tightened. The material of the hold-down clip 60 should be weak enough to bend before the crossmember 34, to release the clamp table from the transverse support member 34 if necessary, without damaging the transverse support member 34. It should also be malleable enough to be bent back to the shape required to hold the clamp table, without breaking, in case it is straightened by the clamp table 44 being accidentally lifted free from the transverse support members 34.

Figure 7:
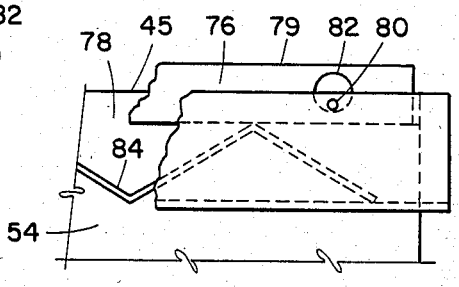
FIG. 7 is a detail view showing one of the material support rails of the clamp table shown in FIG. 4.
Figure 5:
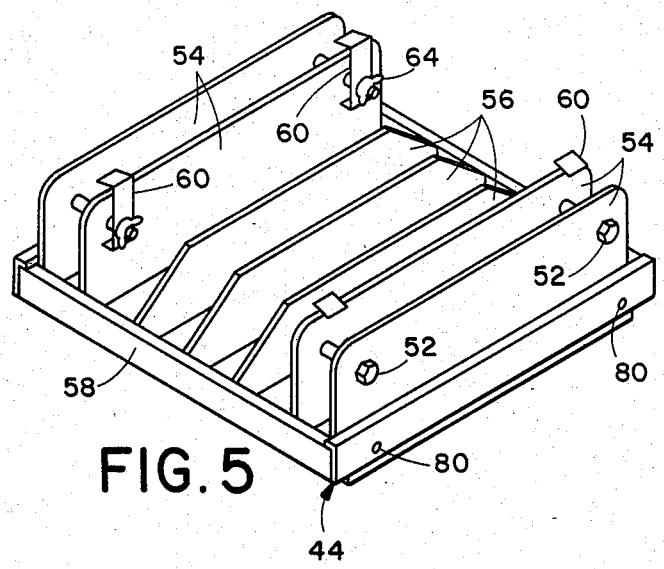
FIG. 5 is an isometric bottom view of the clamp table shown in FIG. 4.

Referring now to FIGS. 6 and 7, a material support rail 76 extends upwardly within a slot 78 extending along the two sides of the clamp table 44 which are parallel with the flanges 54 and reinforcing webs 56. The material supporting members 76 are retained by pins 80 which extend through large holes 82 in the members 76, and springs 84 are disposed within the slots 78 beneath the material support members 76 to hold the support members 76 so that they ordinarily present a horizontal edge 79 located a distance of about ½ inch above the top surface 45 of the clamp table 44. The support members 76 are preferably flat pieces of metal, and the springs 84 are, for example, spring wire bent into a zigzag shape and resiliently deformable enough to permit the support members 76 to move downwardly within the slots 78 until the horizontal edge 79 is flush with the top surface 45.

At each end of the main frame 21 (FIG. 1), extension members 85 are telescopically fitted within the longitudinal grid support members. The extension members 85 are held extended by pins or bolts (not shown). Longitudinal grid position-establishing extension members 87 fit fixably over the extension members 85, extending the series of notches 32 to permit fastening additional transverse support members 34 beyond the length of the main frame 21.

A moveable upper clamp assembly 90, shown in FIGS. 1 and 2, and in greater detail in FIGS. 8 and 9, includes a fixed jaw 92 and a moveable jaw 94, each including a pair of legs 95. A foot 96 is mounted on the extremity of each leg so as to engage the edge strips 58 of each clamp table 44 near the corners of the clamp table 44, as shown in FIG. 9, when the moveable jaw 94 is in a downwardly extending mating position. The upper clamp assembly 90 includes a motor, for example, a double-acting hydraulic cylinder-and-piston assembly 100 connecting to move an upper plate 102 vertically along the length of the fixed jaw 92 toward the top surface 45 of the clamp table 44 when the upper clamp assembly 90 is mated with the clamp table 44 as shown in FIG. 9. The upper plate 102 has a flat bottom surface which is parallel with the top surface 45 where the upper clamp assembly 90 is mated with a clamp table 44 to set fastener plates 59 into the top and bottom of wooden members 46.

The upper plate 102 includes a cam 104 which engages a pin 106 on the moveable jaw 94 to swing the moveable jaw 94 outward and upwardly around a pivot pin 108 when the upper plate 102 is retracted upwardly by the cylinder and piston assembly of the ram 100. When the upper plate 102 is moved downwardly, the ends of a locking bar 110 pass behind a pair of latch rails 112 located on the legs 95 of the moveable jaw 94, as the upper plate 102 moves downward to a position in which the cam 104 and pin 106 permit the moveable jaw 94 to drop to a vertically downwardly extending position. This prevents the moveable jaw 94 from moving and thus retains the upper clamp assembly mated securely with a clamp table 44 as a fastener plate 59 is pressed into wooden members 46.

A limit switch 114 (FIG. 8) is carried on the upper plate 102 and moves along with the upper plate 102 as it moves downwardly. An adjustable limit switch actuating screw 116 located on the fixed jaw 92 actuates the limit switch 114 when the upper plate 102 has moved downwardly to a position determined by adjustment of the actuating screw 116. Actuation of the limit switch 114 stops and reverses the direction of movement of the cylinder-and-piston assembly 100 and thus the upper plate 102.

A handle 118 is connected with a body portion 120 of the upper clamp assembly. A control panel 121 is located on the body 120, adjacent the handle 118, to control operation of the upper clamp assembly 90 as will be explained subsequently.

Preferably, the upper clamp assembly 90 is suspended moveably with respect to the truss assembly apparatus 20 so that it can easily be mated with any of the several clamp tables 44 which may be at various locations on the grid.

Referring now to FIGS. 1, 2 and 10 through 12, a tower 122 is supported by a tower base 124 suspended beneath the main longitudinal frame members 22 by means of, for example, wheels 126 mounted to ride on the flanges of the main longitudinal frame members 22. Alternatively, slidable blocks (not shown) of a friction-resistant material might be used in place of the wheels 126 to slide along the main longitudinal beams 22 to support the tower base 124. Because the frame may at times be supported by the four jacks 29, located at the ends of the main longitudinal grid support members 24, a pair of wheels 127 may be provided on the bottom of the tower base 122, to ride along the ground or other surface on which the apparatus 20 is located, to support the weight of the tower base 122 and tower 124 at least partially, to reduce the size and weight required of the main longitudinal members 22 yet provide freedom for movement of the tower 124 longitudinally along the frame 21 of the apparatus 20.

The tower 122 is of rectangular steel tubular construction, and includes a bearing assembly located in a upper portion thereof to support rotatably an articulated boom assembly comprising an inner boom 128 and an outer boom 130. The inner boom 128 is mounted atop the tower 122 for rotation about a vertical axis with the inner boom 128 extending generally horizontally away from the tower 122. At an outer end 132 of the inner boom 128 the outer boom 130 is suspended for rotation about a vertical axis by means of an outer boom pivot bearing assembly 134, with the majority of the length of the outer boom 130 extending in one direction, and a shorter portion of the outer boom extending in the opposite direction, toward a cable hoist 136. A cable 138 extends from the cable hoist 136 to an outer end 140 of the outer boom 130, thence extending around a pulley 142 (FIG. 11) and downwardly within an inner sleeve 144 extending upwardly within an outer sleeve 145 mounted vertically at the outer end 140 of the boom 130. The cable 138 is attached to the top of the upper clamp assembly 90, permitting the upper clamp assembly 90 to move vertically as the cable 138 is controlled by the cable hoist 136, and also permitting the upper clamp assembly 90 to rotate about a vertical axis extending concentrically through the sleeves 144 and 145.

A pair of crossing trusses 150 extend from the tower 122 to the outer end 132 of the inner boom 128, to counteract torque produced by the outer boom 130 which would otherwise tend to twist the inner boom 128, and a pair of trusses 152 extend diagonally parallel with each other from atop the outer boom pivot bearing assembly 134 to the outer end 140 of the outer boom 130 to assist in transferring the load carried by the outer boom 130 to the outer boom pivot bearing assembly 134.

Figure 12:
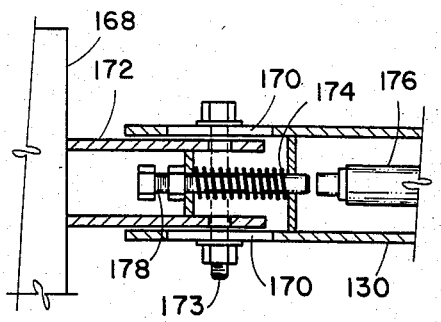
FIG. 12 is sectional detail view of a portion of the outer boom in FIG. 11, taken along lines 12—12.

The cable hoist 136 is mounted within an enclosure 168 having a support arm 172 fitted telescopically within the end of the outer boom 130 (FIG. 12). The arm 172 is permitted to move a short distance axially of the outer boom 130 by a bolt 173 extending through a pair of elongated holes on opposite sides of the outer boom 130 and through the support arm 172. A spring 174 exerts force against a stop within the outer boom 130, urging the support arm 172 away from the outer end 140 of the outer boom 130.

A normally-closed plunger switch 174 is mounted within the boom 130 and connected electrically with the electrical power source for the cable hoist 136. A switch operating bolt 178 is adjustably mounted in the telescopic inner support arm 172, so that when tension in the cable 138, overcoming the force of the spring 174, moves the cable noist 136 and support arm 172 sufficiently, the bolt 178 will push against the plunger of the plunger switch 176. This opens the switch, breaking the electrical circuit to the cable hoist 136, and stops the cable hoist 136, in order to prevent damage to the transverse support members 34 and the boom assembly, which might occur as a result of attempting to raise the upper clamp assembly 90 while it is mated with a clamp table 44.

A hydraulic pump 154 is located in the tower base 124 and driven by, preferably, an electric motor which may be connected to a source of electricity available at the location where the apparatus 20 is being used. The pump 154 is preferably of the type which provides a high volume, low pressure output until pressure increase to a predetermined value and thereafter produces a higher pressure, although with lower volume, so that the upper plate 102 can be moved rapidly except when it is actually pressing fastener plates into wooden members being assembled as a truss of the like. Hydraulic fluid conduits are provided and extend upwardly through the tower 122 and along the booms 128 and 130 and thence downward to the upper clamp assembly 90, along with electrical control cables 158, connected to the control panel 121 to control hydraulic valves (not shown) which regulate hydraulic fluid provided to the hydraulic cylinder-and-piston assembly 100 which drives the upper plate 102.

The control panel 121 also controls valves to regulate hydraulic fluid provided to a hydraulic motor 162 located in the tower base 124 and connected to a pair of spools 164. Wrapped in only two turns about the spools 164 are a pair of tower transport cables 166 which extend longitudinally of the longitudinal frame 21 of the apparatus 20, under sufficient tension to grip the spools 164 tightly enough to move the tower base 124 along the longitudinal members 22 of the apparatus 20 when the hydraulic motor 162 is operated under the control of the control panel 121. The cables 166 are loose enough on the spools 164 to slip, however, should movement of the tower base 124 be obstructed.

The control panel 121 thus includes separate switches to operate the cable hoist 136 to raise or lower the upper clamp assembly 90, to move the tower 122 and tower base 124 longitudinally forward or rearwardly of the apparatus 20, and to raise or lower the upper plate 102.

Referring now to FIG. 13, a plurality of ejector assemblies 180 each include a lower beam 182 which is equipped with clips 184 and pins similar to the clips and pins 38 and 40, and an over-center toggle plunger assembly 186 to permit the ejector assembly 180 to be attached to the longitudinal grid members 30 and 31 in the same way as are the transverse support members 34. A transverse lift beam 188 is located above the lower beam 182 and includes downwardly extending portions slidably moveable upwardly and downwardly within sockets provided in the lower beam 182. A pair of linear motors, such as cylinder-and-piston assemblies 190 operable by compressed air, are provided to raise the transverse lift beam 188 far enough to raise a truss 47 which has been assembled atop the apparatus 20 to a height permitting the truss 47 to be lifted and slid clear of the apparatus 20 along the lift beams 188 without interference with the stops 70 and material support rails 76.

The apparatus 20 is used by placing the jacks 29 on solid supports to hold the weight of the apparatus 20, permitting the wheeled undercarriage 23 to be moved clear of the tower base 124 or to be removed completely. Pairs of transverse support members 34 are fastened at appropriate positions along the longitudinal grid members 30 and 31, and locked in place with jacks 37 used as necessary. Clamp tables 44 are then placed at appropriate positions along each pair of transverse support members 34, and the stops 70 on each of the clamp tables 44 are placed in appropriate positions to act as a jig to properly locate wooden truss members 46 to be joined together to form a structural assembly such as a wooden truss 47. The material support rails 76 hold the wooden truss members 46 above the top surfaces 45 of the clamp tables 44 far enough to permit insertion of fastener plates 59 beneath the wooden members at the appropriate locations, with the prongs of the fastener plates 59 extending upwardly toward the bottom sides of the wooden members.

The upper clamp assembly 90 is then matingly engaged with each of the clamp tables 44 in turn, with the feet 96 hooked beneath the edge strips 58. A second fastener plate 59 is placed atop the wooden members 46 on each clamp table 44, with its prongs extending downwardly toward the wooden members 46, and the cylinder-and-piston assembly 100 is then actuated to move the upper plate 102 downward to press the fastener plates 59 into the wooden members 46. This forces the wooden members 46 downwardly, depressing the material support rails 76 downwardly into the slots 78 to allow the top surface 45 to press against the fastener plate 59 beneath the wooden members as the top plate 102 presses down against the fastener plate 59 atop the wooden members, pressing the two fastener plates 59 into the wooden members 46 to securely fasten the wooden members to one another at that clamp table 44. The same operation is performed similarly at each of the clamp tables 44 in turn, until all of the wooden members 46 have been appropriately connected to one another. Should an operator fail to raise the upper plate 102 far enough to properly disengage the upper clamp assembly 90 from a clamp table 44, the switch 176 will cut off power to the hoist 136, or at worst the hold-down clips 60 will bend to free the clamp table 44, releasing it from its transverse support members 34 before damaging them or the boom assembly.

It will be noted that the legs 95 of the moveable jaw 94 are able to straddle a 2"×6" wooden member **46*a* lying flat (FIG. 1) during pressing, and are long enough to accommodate lumber such as 2"×4" lumber on edge, for floor girder construction. It will also be noted that the stops 70 are short enough to permit full downward motion of the upper plate 102 in pressing the fastener plates 59 into the wooden members 46 of 2" thick lumber of any width used commonly in roof trusses, but are extendable by the extensions 71**, for lumber on edge.

The tower 122 may be moved longitudinally of the apparatus 20 to place the tower 122 close enough to a clamp table 44 located on the extension portions of the apparatus, when the extension members 85 are extended outwardly from the frame members 24 and longitudinal grid position-establishing extension members 87 are fixed in place on the extension members 85, so that a truss or girder longer than the main frame 21 of the apparatus 20 may be constructed by appropriately positioning the tower 122 with respect to the main frame 21.

The terms and expression which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for assembling wooden trusses and girders, comprising:

(a) a main frame;

(b) a plurality of moveable clamp tables, each having a pair of opposite edges;

(c) support means for holding said clamp tables at selected positions laterally and longitudinally located relative to said main frame;

(d) an upper clamp assembly, selectively matable with each of said clamp tables individually at respective different times;

(e) an upper plate included in said upper clamp assembly, said upper clamp assembly being free of any opposingly located lower plate means for supporting any parts being assembled by said apparatus;

(f) mating means included in said upper clamp assembly for selectively holding said opposite edges of one of said clamp tables so as to fasten said upper clamp assembly thereto with said upper plate located above said one of said clamp tables;

(g) motor means associated with said upper plate for controllably moving said upper plate toward one of said clamp tables for pressing fastener plates into wood supported on said one of said clamp tables for joining elements of a truss when said upper clamp assembly is mated with said one of said clamp tables; and (h) boom means supported by said main frame for supporting said upper clamp assembly.

2. The apparatus of claim 1 including a wheeled undercarriage attached to said main frame and moveable longitudinally therealong, for supporting said main frame during transport of said apparatus.

3. Apparatus for assembling wooden trusses and girders, comprising:

(a) a main frame;

(b) a plurality of moveable clamp tables;

(c) support means for holding said clamp tables at selected positions laterally and longitudinally located relative to said main frame, said support means including a pair of longitudinal grid support members each including means for establishing a plurality of regularly spaced-apart positions located therealong, a plurality of moveable elongate transverse support members each having means for defining regularly spaced-apart clamp table positions therealong, means for attaching each of said transverse support members to said main frame in a respective predetermined position relative to said longitudinal grid members, and means for attaching each moveable clamp table to at least one of said moveable transverse support members in a respective predetermined clamp table position therealong;

(d) an upper clamp assembly selectively matable with each of said clamp tables individually at respective different times;

(e) an upper plate included in said upper clamp assembly and motor means associated therewith for controllably moving said upper plate toward one of said clamp tables for pressing fastener plates into wood for joining elements of a truss when said upper clamp assembly is mated with one of said clamp tables; and (f) boom means supported by said main frame for supporting said upper clamp assembly.

4. The apparatus of claim 3, including extension members slidably disposed in said longitudinal grid support members and extendable longitudinally of said apparatus, and including means for establishing a plurality of regularly spaced-apart positions for receiving ones of said transverse support members, located along said longitudinal grid support extension members.

5. The apparatus of claim 3, including at least one hold-down clip assembly associated with each said clamp table, each said hold-down clip assembly including a metal member strong enough to hold said clamp table to said respective transverse support member to prevent movement of said clamp table during normal use of said apparatus, but weak enough to yield sufficiently to permit said clamp table to be lifted from said transverse support member without damaging said transverse support member.

6. The apparatus of claim 3, including ejector means for raising an assembled truss above said clamp tables, said ejector means including a transverse lift beam, a lower beam, means for attaching said lower beam to said main longitudinal grid support members, and motor means for raising said lift beam relative to said lower beam far enough to lift a truss located on said apparatus above said clamp tables.

7. The apparatus of claim 3 including a wheeled undercarriage attached to said main frame and moveable longitudinally therealong, for supporting said main frame during transport of said apparatus.

8. A press for use in assembling wooden trusses and the like, comprising:

(a) a clamp table having a top surface for supporting portions of articles in predetermined locations while joining said articles to one another;

(b) an upper clamp assembly selectively matable with said clamp table;

(c) an upper plate included in said upper clamp assembly and having a lower surface opposed to and parallel with said top surface when said upper clamp assembly is mated with said clamp table, said upper clamp assembly being free of any opposingly located lower plate means for supporting said portions of articles; and (d) press motor means included in said upper clamp assembly, for moving said upper plate toward said top surface and pressing fasteners into said portions of articles between said upper plate and said top surface while joining said articles to one another when said upper clamp assembly is mated with said clamp table.

9. The press of claim 8, including adjustable limiting means responsive to the position of said upper plate, for stopping movement of said upper plate in response to said upper plate reaching a predetermined position.

10. Apparatus for locating wooden members relative to one another and fastening them to one another at predetermined positions along one another, comprising:

(a) a main frame including a pair of main longitudinal members;

(b) adjustably positionable means supported by said main frame for supporting a plurality of wooden members in respective positions for being joined to one another as a wooden structural assembly;

(c) a tower base extending laterally horizontally beneath said main frame and being supported by said main longitudinal members and moveable therealong;

(d) a tower fixedly mounted upon and extending upwardly from said tower base;

(e) an inner boom having an inner end and an outer end, said inner end being pivotably connected to said tower for rotation about a generally vertical axis;

(f) an outer boom pivotably mounted at said outer end of said inner boom and rotatable about a generally vertical axis located at said outer end; and (g) hoist means associated with said outer boom, for supporting a load suspended from said outer boom.

11. The apparatus of claim 10, including motor means carried on said tower base for controllably moving said tower base along said main longitudinal members.

12. The apparatus of claim 11, including a cable spool supported rotatably on said tower base and drivably connected with said motor means, and a cable fixedly attached to said main frame at each end thereof, said cable extending longitudinally along said main frame and being wrapped around said cable spool intermediate the ends of said main frame, so that rotation of said cable spool urges said tower base along said main longitudinal beams.

13. The apparatus of claim 12, wherein said cable is under sufficient tension to grip said spool tightly enough to move said tower base along said main frame under normal conditions, but is loose enough to slip relative to said spool under a predetermined torque applied to said spool when movement of said tower base along said main frame is obstructed.

14. The apparatus of claim 10, including wheel means rotatably mounted on said tower base for resting on a surface above which said main frame extends for supporting said tower base on said surface.

15. The apparatus of claim 10, including a clamp suspended from said outer boom, wherein said outer boom includes guide means for defining a vertical axis of rotation and a vertical path of linear movement of said clamp.

16. A press for use in assembling wooden trusses and the like, comprising:

(a) a clamp table having a top surface for supporting portions of articles in predetermined locations while joining said articles to one another;

(b) upper clamp means selectively matable with said clamp table for pressing fasteners into said portions of articles while joining said articles to one another when said upper clamp means is mated with said clamp table, said upper clamp means including a body, a fixed jaw attached thereto, and a moveable jaw pivotably connected thereto, each of said jaws having foot means attached thereto, for engaging said clamp table and holding said upper clamp means in mating engagement with said clamp table;

(c) an upper plate included in said upper clamp means and having a lower surface opposed to and parallel with said top surface when said upper clamp means is mated with said clamp table; and (d) press motor means included in said upper clamp means, for moving said upper plate towards said top surface when said upper clamp means is mated with said clamp table.

17. The press of claim 16 wherein at least one of said fixed jaw and said moveable jaw defines a fork having a pair of parallel legs separated far enough from one another to permit said at least one jaw to straddle said portions of articles while joining said articles to one another.

18. The press of claim 16, including cam means associated with said body and moveable jaw, for preventing said moveable jaw from moving far enough to disengage said upper clamp means from mating engagement with said clamp table when said upper clamp means is in mating engagement with said clamp table and said lower surface of said upper plate is within a predetermined distance from said top surface.

19. The press of claim 16, including a control panel mounted on said upper clamp means, said control panel including control means connected with said press motor means for controlling movement of said moveable jaws and of said upper plate.

20. The press of claim 16, including adjustable means associated with said upper clamp means, for stopping said press motor means when said lower surface arrives within a predetermined distance from said top surface.

21. The press of claim 16, said clamp table defining a slot, a support rail being vertically moveably disposed within said slot, and biasing means being located within said slot for urging said support rail toward a position in which said support rail extends upwardly a predetermined distance above said top surface.

22. The press of claim 16, said clamp table having a peak locator associated therewith, said peak locator including a pair of pivotably connected rails located above and extending along said top surface and means for adjustably fastening said rails at any of a plurality of positions along said top surface.

23. A press for use in assembling wooden trusses and the like, comprising:

(a) a clamp table having a top surface for supporting portions of articles in predetermined locations while joining said articles to one another;

(b) at least one stop extending upwardly above said top surface;

(c) means for adjustably fastening said stop at any of a plurality of positions along said top surface;

(d) upper clamp means selectively matable with said clamp table for pressing fasteners into said portions of articles while joining said articles to one another when said upper clamp means is mated with said clamp table;

(e) an upper plate included in said upper clamp means and having a lower surface opposed to and parallel with said top surface when said upper clamp means is mated with said clamp table; and (f) press motor means included in said upper clamp means, for moving said upper plate towards said top surface when said upper clamp means is mated with said clamp table.

24. A press for use in assembling wooden trusses and the like, comprising:

(a) a clamp table having a top surface for supporting portions of articles in predetermined locations while joining said articles to one another;

(b) at least one hold-down clip assembly associated with said clamp table, each said hold-down clip assembly including a yieldingly deformable metal strap member and means for holding said strap member in position extending partly beneath an object located on said clamp table so as to connect said table to said object;

(c) upper clamp means selectively matable with said clamp table for pressing fasteners into said portions of articles while joining said articles to one another when said upper clamp means is mated with said clamp table;

(d) an upper plate included in said upper clamp means and having a lower surface opposed to and parallel with said top surface when said upper clamp means is mated with said clamp table; and (e) press motor means included in said upper clamp means, for moving said upper plate towards said top surface when said upper clamp means is mated with said clamp table.

* * * * *